US005149915A

United States Patent [19]

Brunker et al.

[11] Patent Number: 5,149,915

[45] Date of Patent: Sep. 22, 1992

[54] HYBRID SHIELDED CABLE

[75] Inventors: David L. Brunker, Naperville; Burke J. Crane, Lombard; John E. Lopata, Naperville, all of Ill.

[73] Assignee: Molex Incorporated, Lisle, Ill.

[21] Appl. No.: 711,230

[22] Filed: Jun. 6, 1991

[51] Int. Cl.[5] ..... H01B 7/34

[52] U.S. Cl. ..... 174/36; 174/105 R; 174/113 R; 174/113 AS; 174/115; 174/107

[58] Field of Search ..... 174/34, 36, 105 R, 113 R, 174/113 C, 113 AS, 115, 107

[56] References Cited

U.S. PATENT DOCUMENTS

| | | | |
|---|---|---|---|
| 2,268,223 | 12/1941 | Peterson | 174/113 R X |
| 2,953,627 | 9/1960 | Malneritch et al. | 174/113 R X |
| 3,710,006 | 1/1973 | Davis | 174/113 C X |
| 4,049,904 | 9/1977 | Hori et al. | 174/107 |
| 4,461,923 | 7/1984 | Bogese, II | 174/36 |
| 4,486,623 | 12/1984 | Ploppa | 174/113 R |
| 4,538,022 | 8/1985 | Barnicol-Ottler et al. | 174/113 R |
| 4,800,236 | 1/1989 | Lemke | 174/36 |
| 4,816,611 | 3/1989 | Invernizzi | 174/131 A X |
| 5,043,530 | 8/1991 | Davies | 174/36 |

FOREIGN PATENT DOCUMENTS

| | | | |
|---|---|---|---|
| 259221 | 7/1949 | Switzerland | 174/105 R |
| 482926 | 4/1938 | United Kingdom | 174/105 R |

*Primary Examiner*—Morris H. Nimmo
*Attorney, Agent, or Firm*—Charles S. Cohen

[57] ABSTRACT

A multi-conductor hybrid cable construction includes a plurality of inner signal conductors. A unitary dielectric member surrounds, insulates, spaces and joins the inner signal conductors in a circular array about the axis of the cable. An inner conductive shield is disposed about the unitary dielectric member and the surrounded inner conductors. A plurality of outer data conductors are arranged circumferentially about the inner conductive shield. An outer conductive shield is disposed about the outer data conductors. A central dielectric filler is disposed inside the unitary dielectric member, and an insulating jacket is disposed about the outer conductive shield forming the outside of the cable.

27 Claims, 1 Drawing Sheet

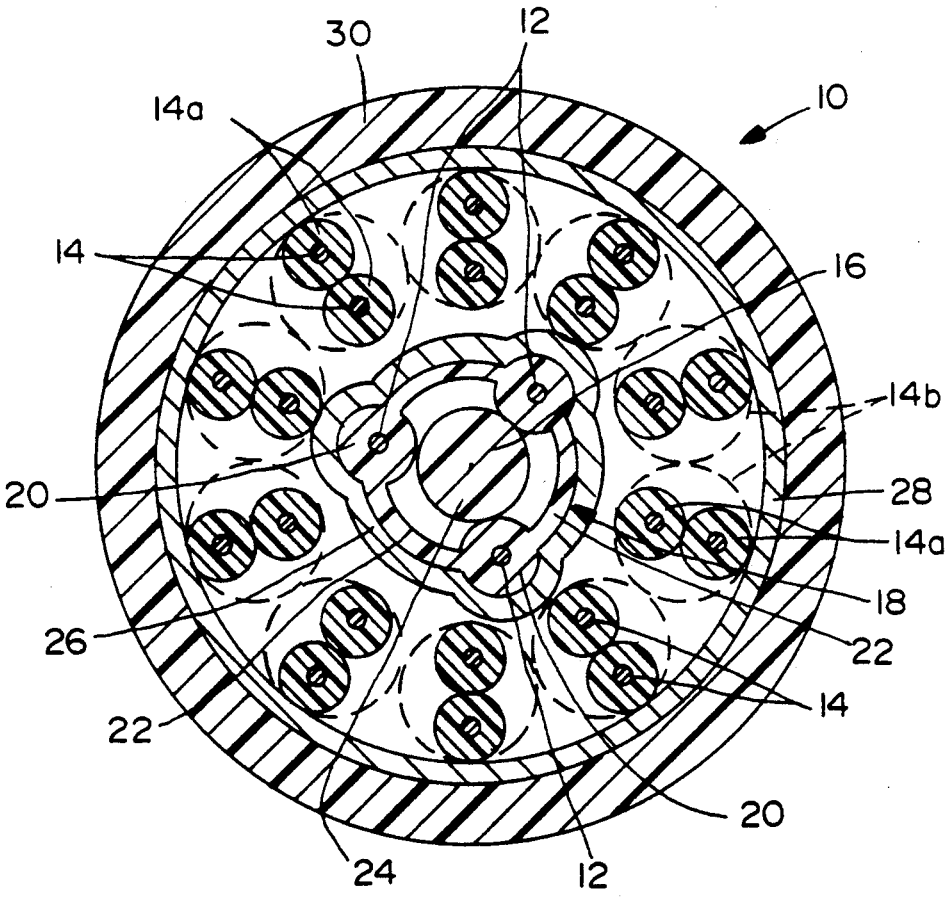
30
12
14a
10
14
16
14b
20
28
14a
18
26
22
14
22
20
24
12

HYBRID SHIELDED CABLE

FIELD OF THE INVENTION

This invention generally relates to the art of electrical cables and, particularly, to a hybrid shielded cable for a signal transmission line including a plurality of conductors.

BACKGROUND OF THE INVENTION

Shielded electrical cables are used as transmission lines, either in round or flat form, to transmit signals through a plurality of conductors which, preferably, are physically separated and electromagnetically isolated along their entire length. Shielded cables presently are used predominantly in relatively high speed applications between various system components in data processing networks, high speed video systems and the like. Coaxial cables are typically used in a singular conductor configurations in high frequency video applications. The lower frequency data transmission lines are often separate from the video signals due to circuit considerations such as impedance, balanced transmission systems and common mode rejection. Generally, improvements in these circuit considerations require relatively large cable and costly construction, neither of which is desirable. In a cable transmitting high frequency signals, it is important to control impedance. It also is important to control cross-talk (internal) between the multiple transmission lines. Still further, it is important to prevent radiation to and from the transmission lines to the outside (external). Achieving such characteristics in a very high density coaxial cable, particularly with the ever-increasing miniaturization of transmission systems, becomes increasingly difficult.

This invention is directed to solving these problems in a hybrid cable design intended for use as a high density multi-channel cable to provide controlled impedance with minimal cross-talk and full shielding against radiated emissions, and particularly in a high density hybrid or mixed cable incorporating high speed transmission lines , such as for a video monitor, as well as twisted pair data transmission lines which have lower bandwidth and therefore slower data speed.

SUMMARY OF THE INVENTION

An object, therefore, of the invention is to provide a new and improved multi-conductor hybrid cable of the character described.

In the exemplary embodiment of the invention, a multi-transmission line shielded cable construction includes a plurality of inner conductors (which will be termed signal conductors). A unitary dielectric member surrounds the signal conductors and joins them in a circular array about the axis of the cable. An inner conductive shielding means is disposed about the unitary dielectric member and the surrounded signal conductors. A plurality of outer twisted pair conductors (which will be termed data conductors) are arranged circumferentially about the conductive inner shielding means. An outer conductive shielding means is disposed about the data conductors transmission lines.

In the preferred embodiment of the invention, an insulating jacket is disposed about the outer conductive shielding means; a central dielectric filler is disposed inside the unitary dielectric member and the surrounded signal conductors; the signal conductors are disposed within the unitary dielectric member equally spaced from each other angularly about the axis of the cable; and the data conductors are disposed between the inner and outer shielding means equally spaced from each other angularly about the axis of the cable. Each data conductor comprises a multi-stranded wire.

The unitary dielectric member includes enlarged portions individually surrounding the signal conductors and joined by narrow web portions. The dielectric member separates the signal conductors and maintains their equal spacing. The central dielectric filler assists in maintaining the overall spacing. The inner conductive shielding means is provided in the form of a layer of uniform thickness juxtaposed with and conforming to the outer peripheral shape of the unitary dielectric member.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawing in which the single figure is a crosssectional view through the cable of the invention.

DETAILED DESCRIPTION OF THE PREFERRED EMBODIMENT

Referring to the drawing in greater detail, the single figure is a cross-section through a multi-conductor shielded cable construction, generally designated 10. The cable diameter is approximately $\frac{3}{8}$ of an inch. The cable includes three inner conductors 12 and a plurality of outer conductors 14. As stated above, the shielded cable of the invention is illustrated as a mixed or integrated shielded cable which incorporates both high frequency signal conductors, such as signal transmission lines to a high speed video monitor, along with data transmission lines having slower requirements servicing balanced transmission line contacts. Therefore, as termed hereinafter, inner conductors 12 will be termed signal conductors and outer conductors 14 will be termed data conductors, although the invention has other applications.

In addition, as used hereinafter and in the claims hereof, such terms as "inner", "outer", "circumferentially", "circular", "central", "layer", "thickness", and like terms will refer to characteristics relative to a central axis 16 of the cable 10. In other words, it is well known in the art that the components shown in any cross-sectional depiction through a cable will run the entire axial length of the cable.

With those understandings, a unitary dielectric member, generally designated 18, surrounds signal conductors 12 and joins the conductors in a circular array about axis 16 of cable 10. More particularly, unitary dielectric member 18 includes enlarged, generally circular portions 20 of uniform thickness and individually surrounding each signal conductor 12. A plurality of narrow web portions 22, of uniform thickness, join enlarged portions 20. The webs are shown as being narrower than enlarged portions 20 but they could be the same thickness if desired. The dielectric member serves to separate signal conductors 12, insulate the conductors and maintain the conductors at consistent spacing equally and angularly about axis 16 of the cable and from conductive shielding means 26. In the alternative, web portions 22 could be omitted and a nonconductive filler (not shown) that would function to maintain the desired spacing between the conductors could be substituted. A central, dielectric filler strand 24 is disposed on axis 16 of the cable and, as shown, engages the inside of enlarged portions 20 of dielectric member 18 but could also engage webs 22. This filler strand assists in maintaining the overall spacing of the signal conductors.

An inner conductive shielding means 26, such as in the form of a conductive braid, aluminum foil on polyester, or other combinations suitable for effective shielding, is disposed about unitary dielectric member 18 and the surrounded signal conductors. As seen in the depiction, inner conductive shielding means 26 is in the form of a layer of uniform thickness juxtaposed with and conforming to the outer irregular peripheral shape of the unitary dielectric member 18. This inner shielding means defines a ground plane about unitary dielectric member 18 and the surrounded signal conductors 12. This inner shielding means provides a full shield against outwardly radiated emissions from the signal conductors and controls or minimizes cross-talk between the signal conductors. The inner shielding means 26 also acts as the primary electrical reference for each signal conductor 12 thereby establishing a controlled impedance condition.

As can be seen in the drawing, data conductors 14 are arranged circumferentially about inner conductive shielding means 26. The data conductors are disposed in a circular array of equal spacing from each other angularly about axis 16 of the cable. Data conductors 14 are shown in pairs surrounded by insulating cladding 14*a*. These cladded conductors are provided in twisted pairs, as represented by a twisting profile indicated by dotted circles 14*b*.

An outer shielding means 28 in the form of a conductive braid, aluminum foil on polyester or other combinations suitable for effective shielding is disposed about data conductors 14 and may be provided as a metallic braid of circular configuration, as shown. The outer conductive shielding means 28, in combination with the inner shielding means 26, provides additional impedance control for the electrically balanced twisted pair conductors 14.

Finally, a circular insulating jacket 30 of uniform thickness is disposed about outer conductive shielding means 28 and defines the outside of the cable. This outer jacket is typically fabricated of dielectric material, such as plastic or the like.

From the foregoing, it can be seen that shielded cable 10 includes a plurality of inner cables 12 which are surrounded by a common ground 26. The inner cable conductors are separated by an insulator in the form of unitary dielectric web member 18. The insulator maintains a consistent spacing for the inner conductors. The insulator is disposed about filler strand 16, in engagement with enlarged portions 20 of the insulator, to assist in maintaining the overall spacing of the inner signal conductors. The outer data conductors 14, provided by ten twisted pairs (or twenty conductors), are sandwiched between the inner and outer shielding means 26 and 28, respectively. The entire construction is jacketed by outer insulating jacket 30 to form a single cable which not only provides the required characteristics of controlling internal cross talk, controlling impedance and preventing radiated emissions, but also increases the density of the cable when compared to a standard cable that has the same or similar performance characteristics.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A multi-conductor hybrid cable construction, comprising:

a plurality of signal conductors;

a unitary dielectric member surrounding the signal conductors and integrally joining the conductors in a circular array about the axis of the cable;

inner conductive shielding means about the unitary dielectric member and the surrounded signal conductors;

a plurality of data conductors arranged circumferentially about the inner conductive shielding means; and an outer conductive shielding means about the data conductors.

2. The multi-conductor hybrid cable construction of claim 1, including an insulating jacket about the outer conductive shielding means.

3. The multi-conductor hybrid cable construction of claim 1, including a central dielectric filler inside the unitary dielectric member and the surrounded signal conductors.

4. The multi-conductor hybrid cable construction of claim 1 wherein said signal conductors are disposed within the unitary dielectric member equally spaced from each other angularly about the axis of the cable.

5. The multi-conductor hybrid cable construction of claim 1 wherein said data conductors are disposed between the inner and outer shielding means equally spaced from each other angularly about the axis of the cable.

6. The multi-conductor hybrid cable construction of claim 5 wherein each of said data conductors comprises a multi-stranded wire.

7. The multi-conductor hybrid cable construction of claim 1 wherein said unitary dielectric member includes enlarged portions individually surrounding and insulating each signal conductor and joined by narrow web portions spacing the conductors.

8. The multi-conductor hybrid cable construction of claim 7 wherein said inner conductive shielding means comprises a layer of uniform thickness juxtaposed with and conforming to the outer peripheral shape of the unitary dielectric member.

9. The multi-conductor hybrid cable construction of claim 1 wherein said outer conductive shielding means comprises a circular shield.

10. A multi-conductor hybrid cable construction, comprising:

a plurality of inner signal conductors;

a unitary dielectric member surrounding the inner conductors and integrally joining the conductors in a circular array about the axis of the cable, said unitary dielectric member including portions individually surrounding and insulating each signal conductor and joined by web portions spacing the conductors; and a conductive shielding means about the unitary dielectric member and the surrounded signal conductors.

11. The multi-conductor hybrid cable of claim 10, including an insulating jacket around the outside of the cable.

12. The multi-conductor hybrid cable of claim 10, including a central dielectric filler inside the unitary dielectric member and the surrounded inner signal conductors.

13. The multi-conductor hybrid cable of claim 10 wherein said inner signal conductors are disposed within the unitary dielectric member equally spaced from each other angularly about the axis of the cable.

14. The multi-conductor hybrid cable of claim 10 wherein said conductive shielding means comprises a layer of uniform thickness juxtaposed with and conforming to the outer peripheral shape of the unitary dielectric member.

15. A multi-conductor, hybrid cable, comprising:

a plurality of inner signal conductors;

dielectric means surrounding the inner conductors and joining the conductors in a circular array about the axis of the cable;

inner conductive shielding means about the dielectric means and the surrounded inner conductors;

a plurality of outer data conductors arranged circumferentially about the inner conductive shielding means; and an outer conductive shielding means about the outer data conductors.

16. The multi-conductor hybrid cable of claim 15, including an insulating jacket about the outer conductive shielding means.

17. The multi-conductor hybrid cable of claim 15, including a central dielectric filler inside the dielectric means and the surrounded inner signal conductors.

18. The multi-conductor hybrid cable of claim 15 wherein said inner signal conductors are disposed in the dielectric means equally spaced from each other angularly about the axis of the cable.

19. The multi-conductor hybrid cable of claim 15 wherein said outer data conductors are disposed between the inner and outer shielding means equally spaced from each other angularly about the axis of the cable.

20. The multi-conductor hybrid cable of claim 19 wherein each of said outer data conductors comprise a multi-stranded wire.

21. The multi-conductor hybrid cable of claim 15 wherein said dielectric means comprises an unitary dielectric member having enlarged portions individually surrounding and insulating each inner signal conductor and integrally joined by narrow web portions spacing the conductors.

22. The multi-conductor hybrid cable of claim 21 wherein said inner conductive shielding means comprises a layer of uniform thickness juxtaposed with and conforming to the outer peripheral shape of the unitary dielectric member.

23. A multi-conductor cable construction, comprising:

a plurality of inner signal conductors;

a unitary dielectric member having enlarged portions individually surrounding and insulating each inner signal conductor and integrally joined by web portions equally spacing the inner signal cables angularly about the axis of the cable;

inner conductive shielding means about the unitary dielectric member and the surrounded inner signal conductors;

a plurality of outer data conductors arranged circumferentially about the inner conductive shielding means at equal spacing from each other angularly about the axis of the cable;

an outer conductive shielding means about the outer data conductors; and an insulating jacket about the outer conductive shielding means.

24. The multi-conductor cable construction of claim 23, including a central dielectric filler inside the unitary dielectric member and the surrounded inner conductors.

25. The multi-conductor cable construction of claim 23 wherein each of said outer data conductors comprises a multi-stranded wire.

26. The multi-conductor cable construction of claim 23 wherein said inner conductive shielding means comprises a layer of uniform thickness juxtaposed with and conforming to the outer peripheral shape of the unitary dielectric member.

27. The multi-conductor cable construction of claim 23 wherein said outer conductive shielding means comprises a circular shield.

* * * * *